US007494268B2

(12) United States Patent
Conus et al.

(10) Patent No.: US 7,494,268 B2
(45) **Date of Patent: *Feb. 24, 2009**

(54) DETENT ESCAPEMENT FOR TIMEPIECE

(75) Inventors: Thierry Conus, Lengnau (CH); Andrés Cabezas Jurin, Yverdon-les-Bains (CH)

(73) Assignee: Montres Brequet SA, L'Abbaye (CH)

( * ) Notice: Subject to any disclaimer, the term of this patent is extended or adjusted under 35 U.S.C. 154(b) by 490 days.

This patent is subject to a terminal disclaimer.

(21) Appl. No.: 11/277,652

(22) Filed: Mar. 28, 2006

(65) Prior Publication Data

US 2006/0221774 A1 Oct. 5, 2006

(30) Foreign Application Priority Data

Mar. 30, 2005 (EP) ..... 05006851

(51) Int. Cl.
*G04B 15/00* (2006.01)

(52) U.S. Cl. ..... 368/127; 368/131

(58) Field of Classification Search ..... 368/124, 368/125, 127, 128, 129, 130, 131
See application file for complete search history.

(56) References Cited

U.S. PATENT DOCUMENTS 3,538,705 A * 11/1970 Perry ..... 368/125
4,122,665 A * 10/1978 Giger ..... 368/327
6,942,378 B2 * 9/2005 Hayek et al. ..... 368/127
7,040,803 B2 * 5/2006 Hayek et al. ..... 368/127

FOREIGN PATENT DOCUMENTS

| | | |
|---|---|---|
| CH | 3 299 | 8/1891 |
| CH | 64 175 | 1/1977 |
| EP | 1 538 491 A1 | 6/2005 |
| EP | 1 544 689 A1 | 6/2005 |

OTHER PUBLICATIONS

Derwent Abstract Accession No. R25, SU 479075 A (Watch RES INST), Oct. 13, 1976.
Derwent Abstract Accession No. S04, C/45, SU 723491 A (BYSTROV), Mar. 28, 1980.

* cited by examiner

*Primary Examiner*—Renee S Luebke
*Assistant Examiner*—Jason Collins
(74) *Attorney, Agent, or Firm*—Sughrue Mion, PLLC

(57) ABSTRACT

The escapement includes a large roller 4 carrying an impulse pallet stone 5 surmounted by a first finger-piece 14 and a small roller 23 in which a notch 22 is made. A blocking member carries, on the one hand, a device 80 for locking the escape wheel 2, and on the other hand, a second finger-piece 11 arranged for cooperating with the first finger-piece 14, the blocking member also including a follower 20 ending in a beak 21 which acts on the small roller and particularly with notch 22 which is made therein. The first and second finger-pieces 14 and 11 are respectively rigidly secured to the table roller and the blocking member.

6 Claims, 7 Drawing Sheets

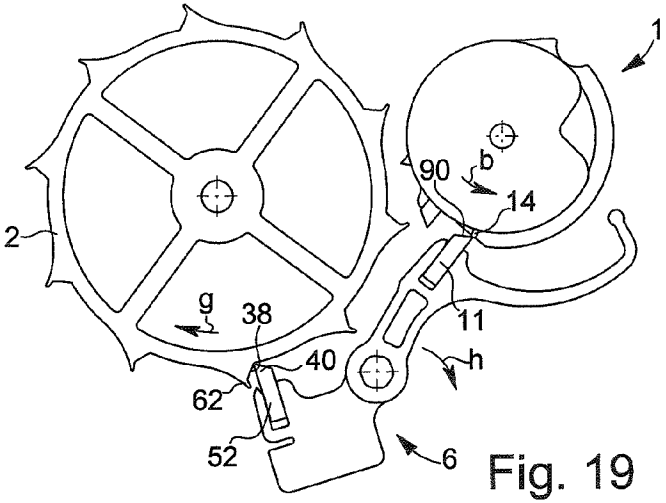
Fig. 19
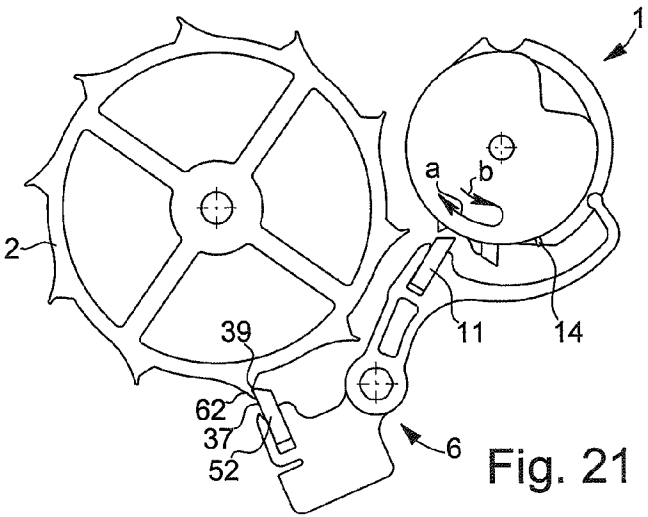
Fig. 21
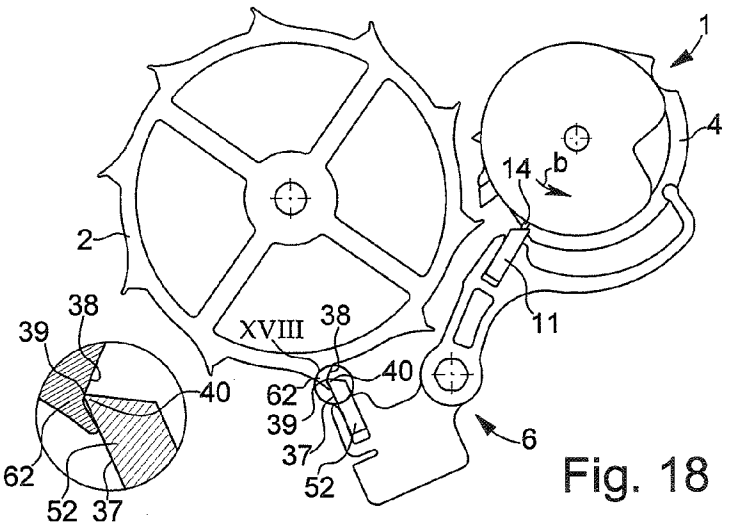
Fig. 18
Fig. 18a
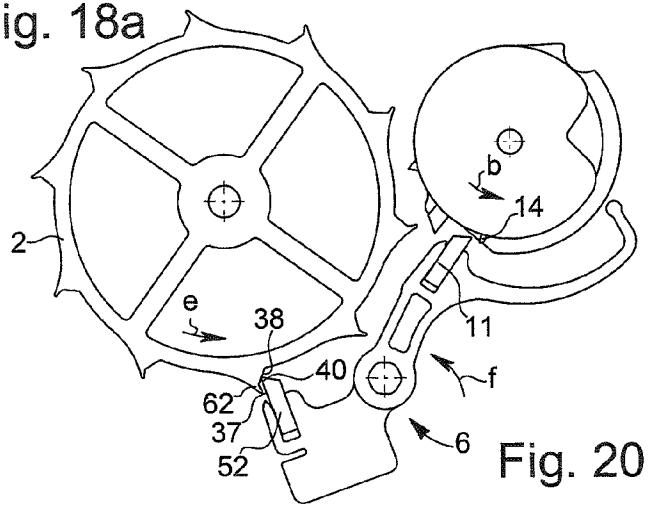
Fig. 20

DETENT ESCAPEMENT FOR TIMEPIECE

BACKGROUND OF THE INVENTION

The present invention relates to a detent escapement for a timepiece comprising an escape wheel provided with teeth, a balance onto the staff of which rollers are secured including a large roller provided with an impulse pallet stone and surmounted by a first actuating finger-piece, and a small roller in the circular periphery of which a notch is made, and a blocking member in the form of a lever hinged on a pin, said blocking member carrying means for locking the escape wheel, a second actuating finger-piece and a follower ending in a beak arranged for cooperating with a rising edge of the notch of the small roller.

A detent escapement answering the above description has already been proposed in European Patent Application No. 03027929.3, filed on 4 Dec. 2003. However, in that patent application a resilient member acts on one of the actuating finger-pieces—in that case on the first finger-piece forming part of the balance roller—such that the finger-piece operates the release of the blocking member when the roller is rotating in a first direction and keeps said blocking member engaged in the escape wheel when the roller is rotating in a second direction opposite to the first. In this second rotational direction, the finger-piece resiliently attached to the roller retracts when faced with the finger-piece fixed to the blocking member. It should also be mentioned that the escapement of the aforecited patent application, in addition to using the aforementioned resilient member, requires the use of a stop pin for limiting the play of the blocking member and keeping it there in a certain shape while the roller performs its supplementary arc of oscillation.

It will be understood that if the resilient member, on the one hand, and the stop pin fitted to the escapement mentioned in the above paragraph could be omitted, the construction of the assembly would be considerably simplified, and this is the object of the present invention.

A detent escapement free of any resilient members and with no stop pin was proposed in European Patent Application No. 03028877.3 filed on 16 Jan. 2003. In this patent application, the escapement includes a large roller carrying a first finger-piece and a blocking member carrying a second finger-piece and a locking pallet stone. The first and second finger-pieces are shaped such that when the large roller is rotating in a first direction, the first finger-piece drives the second which passes round a first side of said first finger-piece to release the locking pallet stone from the escape wheel. Re-engagement occurs when the second finger-piece scales a rising edge of a notch made in a small roller. When the large roller is rotating in a second direction opposite to the first, the first finger-piece drives the second finger-piece which passes round a second side, opposite the first side, of said first finger-piece to hold the locking pallet stone in the escape wheel.

It will be understood here that the shocks created when the first and second finger-pieces meet exert a perpendicular force to the rotational axis of the blocking member. Moreover, the finger-pieces in question are made of edges that could enter into collision and break in the mechanism if the latter is incorrectly adjusted. Improved reliability is another object of the present invention.

SUMMARY OF THE INVENTION

In order to answer the criteria and objects stated hereinbefore, in addition to answering the first paragraph of this description, the present invention is characterized in that the first and second actuating finger-pieces are rigidly secured respectively to the large roller and to the blocking member and arranged to cooperate with each other such that when the rollers are rotating in a first direction, the first finger-piece drives the second to release the escape wheel locking means, the beak of the follower being then driven by the rising edge of the notch to re-engage the locking means in the escape wheel, and in such a way that when the rollers are rotating in a second direction, opposite to the first, the first finger-piece drives the second to keep the locking means engaged in the escape wheel.

BRIEF DESCRIPTION OF THE DRAWINGS

The invention will now be explained in detail via several embodiments given by way of example, these embodiments being illustrated by the annexed drawings, in which:

FIGS. 18 to 21 are plan views explaining the operating phases of the escapement according to the second embodiment of the invention, these phases covering the second vibration of an oscillation of the balance;

FIG. 18*a* is an enlargement of the area XVII of FIG. 18.

DETAILED DESCRIPTION OF THE INVENTION

Figure 1:
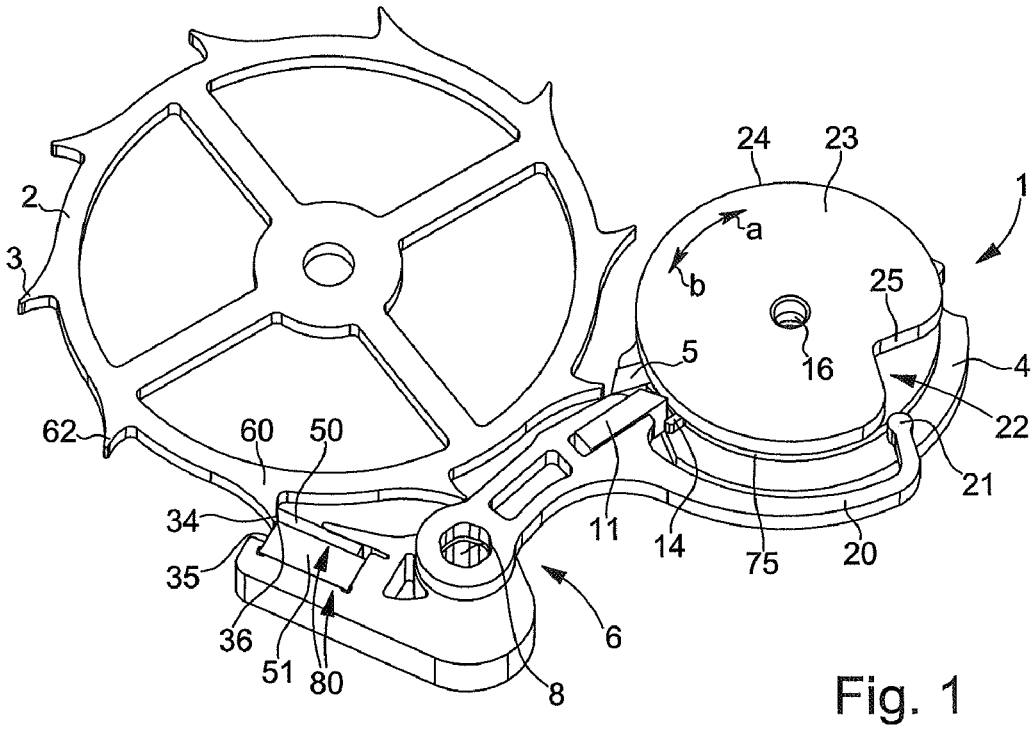
FIG. 1 is a perspective view of an embodiment of the escapement according to the invention.
Figure 2:
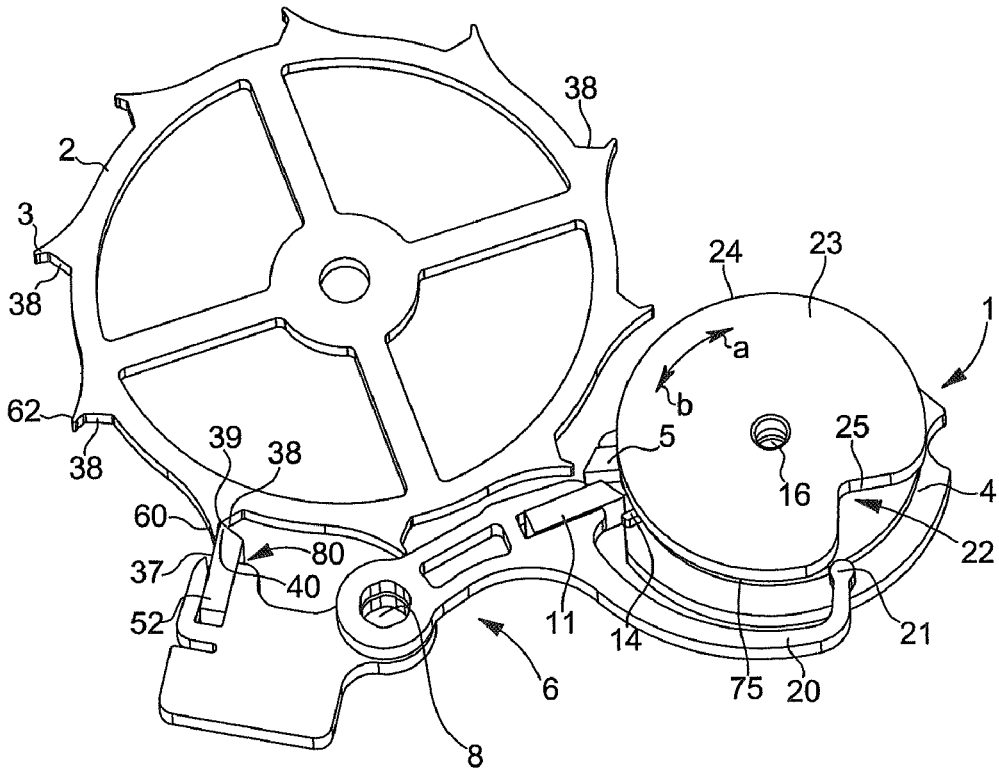
FIG. 2 is a perspective view of a second embodiment of the escapement according to the invention.

The annexed Figures illustrate the detent escapement forming the subject of the present invention. The detent escapement includes an escape wheel 2 provided with teeth 3. Although this is not shown, wheel 2 is driven by the train of the timepiece which receives its drive force from a barrel. Rollers 1 are mounted on a balance staff 16 that is not shown in the Figures. These rollers 1 include a large roller 4 fitted with an impulse pallet stone 5 and a small roller 23 provided with a circular periphery 24 in which a notch 22 is made having a rising edge 25. A first actuating finger-piece 14 surmounts large roller 4. The Figures show that this finger-piece 14 emerges from a disc 75 sandwiched between rollers 4 and 23. The escapement further includes a blocking member 6 in the form of a lever hinged on a pin 8. Blocking member 6 includes first and second parts fixedly connected by pin 8. The Figures show that the first part includes locking means 80 cooperating with the teeth 3 of escape wheel 2 and that the second part includes a second actuating finger-piece 11 arranged for cooperating with the first finger-piece 14, and a follower 20 ending in a beak 21 arranged for cooperating with rising edge 25 of notch 22 made in small roller 23.

From the description that has just been given, it will be seen that all the components necessary to make a detent escapement are present. In this escapement, the wheel is released when the rollers are rotating in one direction whereas it remains locked when the rollers are rotating in the other direction. Thus the impulse is only given to the balance once per oscillation during which the escape wheel rotates by one angular step whereas, in the lever escapement, the same wheel progresses by a half-step at each vibration. This constitutes one of the advantages of the detent escapement since the energy wasted by the inertia of the escape wheel only occurs once per oscillation instead of once per vibration.

With respect to the first European Patent Application No 03027929.3 cited above, the present invention is remarkable in that the first and second actuating finger-pieces 14 and 11 are rigidly secured respectively to the large roller 4 and to the blocking member 6, whereas in the first aforecited application, a resilient member acts on one of the actuating finger-pieces thereby enabling the finger-piece to drive the blocking member when the rollers are rotating in a first direction and to be retracted when said rollers are rotating in the second direction. The present invention thus makes this resilient member irrelevant, while also making the use of a stop pin superfluous.

With respect to the second European Patent Application No. 03028877.3 cited above, the present invention is remarkable in that the first ands second actuating finger-pieces 14 and 11 are arranged for cooperating with each other such that when rollers 1 are rotating in a first direction, the first finger-piece 14 drives the second finger-piece 11 to unlock the locking means 80 for escape wheel 2, beak 21 of follower 20 being then driven by the rising edge 25 of notch 22 to re-engage the locking means in the escape wheel, and such that when rollers 1 are rotating in a second direction, opposite to the first, the first finger-piece 14 drives the second 11 to keep locking means 80 engaged in escape wheel 2. It will be noted that in the second aforecited patent application, it is the second actuating finger-piece 11 that is responsible for re-engaging the locking means in the escape wheel and that a follower ending in a beak is not used. Consequently the relative positions of the two drive finger-pieces are very different from the positions used in the present invention. Thus, in the present invention, any encounter of the two finger-pieces, whether in one rotational direction of the rollers or the other, generates a rotating and natural force on the blocking member pin, and this encounter does not generate any risk of breaking the mechanism.

Several embodiments of the invention will now be described, differing essentially in the locking means 80 that are implemented.

The first embodiment is illustrated in FIGS. 1 and 6 to 17. The locking means 80 have first and second pallet stones 50 and 51, arranged one beside the other. These pallet stones have respectively first and second locking planes 34 and 35. These locking planes are inclined in relation to each other to form a locking line 36. As will be seen hereinafter, following the detailed analysis of the operating phases of the escapement, the first plane 34 intercepts a tooth 62 of wheel 2 when follower 20 is being driven by rising edge 25 of notch 22, rollers 1 rotating in a first direction. After this, tooth 62 comes to rest on locking line 35. The second plane 35 is then scaled by the same tooth 62 when first finger-piece 14 is driving second finger-piece 11, rollers 1 rotating in a second direction. Finally, tooth 62 returns to locking line 35 when the second finger-piece leaves the first.

One complete oscillation of the balance is illustrated in FIGS. 6 to 17. The different phases of operation will now be analysed.

Figure 6:
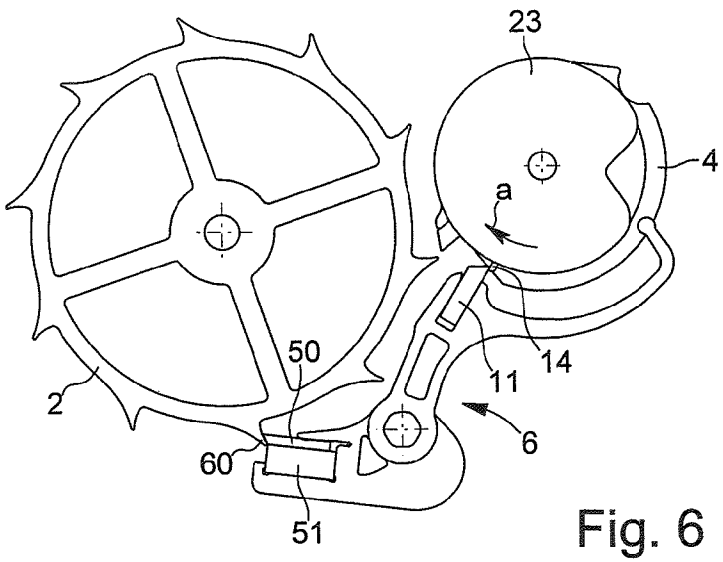

In FIG. 6, rollers 4 and 23 are rotating in the direction of arrow a. The first finger-piece 14 surmounting large roller 4 enters into contact with the second finger-piece 11 of blocking member 6. Locking pallet stones 50 and 51 are fully engaged in tooth 60 of wheel 2 which is locked. Since this is the beginning of contact between the roller and blocking member, this is the beginning of the unlocking.

Figure 7:
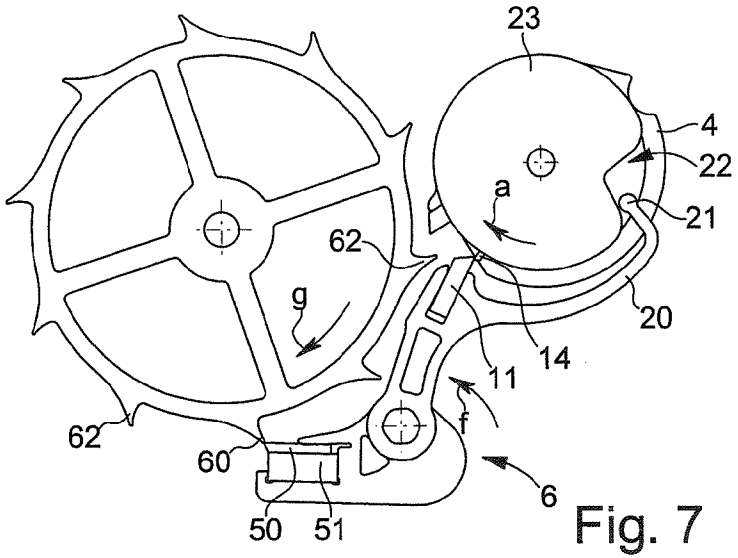
FIGS. 6 to 17 are plan views explaining the operating phases of the escapement according to the first embodiment of the invention, these phases covering the first and second vibrations of one oscillation of the balance.

The end of unlocking is shown in FIG. 7. As rollers 4 and 23 are still rotating in the direction of arrow a, finger-piece 14 is driving finger-piece 11 while tipping blocking member 6 in the direction of arrow f which unlocks locking pallet stones 50 and 51 from tooth 60 while imparting a slight backward movement on wheel 2 in the direction of arrow g. Beak 21 of follower 20 starts to penetrate notch 22 of small roller 23.

Figure 8:
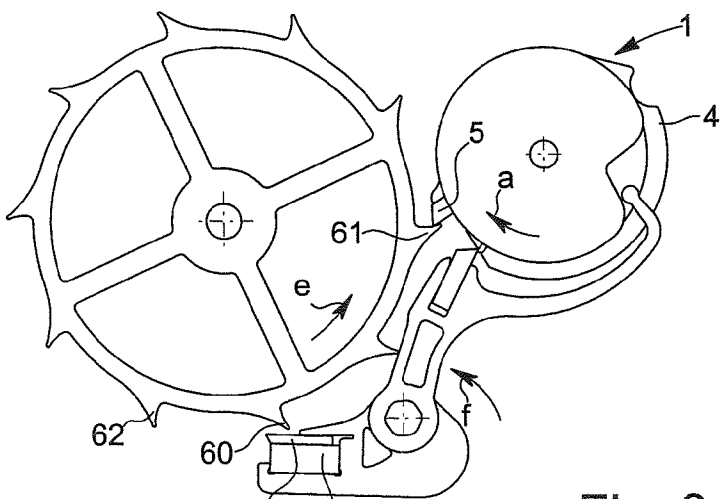

The start of the impulse is shown in FIG. 8. Wheel 2, released from locking pallet stones 50 and 51, begins to rotate in the direction of arrow e, moved by the drive force that the barrel confers on the gear train. Tooth 61 of wheel 2 encounters impulse pallet stone 5 fitted to large roller 4 and sends rollers 1 back in the direction of arrow a.

Figure 9:
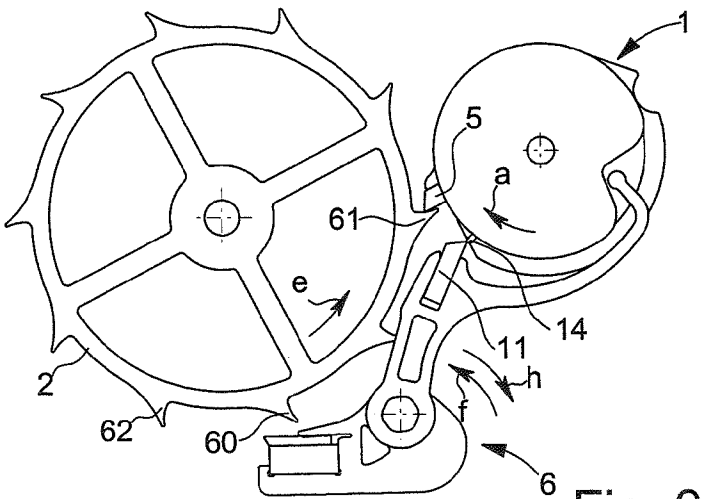

FIG. 9 shows the impulse in progress. Roller 1 and wheel 2 continue to rotate in the direction of arrows a and e respectively. Upon reaching the end of the contact between the roller and blocking member, finger-piece 14 prepares to pass over the tip of tooth 11. Blocking member 6 which was tipping in the direction of arrow f, prepares to tip in the other direction (arrow h).

Figure 10:
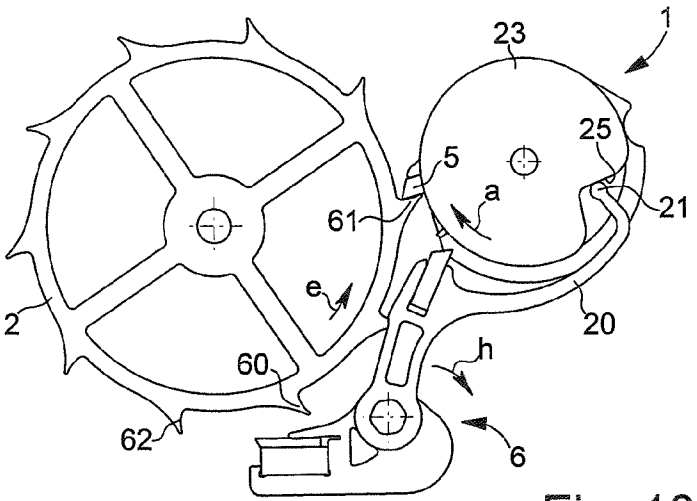

In FIG. 10, wheel 2 continues to rotate in the direction of arrow e and continues to drive rollers 1 via the action of tooth 61 on impulse pallet stone 5 until the moment when beak 21 of follower 20 enters into contact with rising edge 25 of small roller 23. Henceforth, blocking member 6 is driven in the direction of arrow h.

Figure 11:
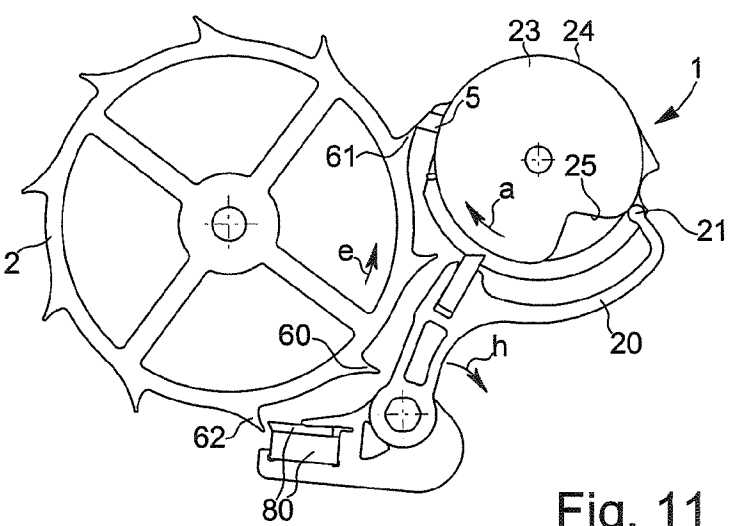

FIG. 11 illustrates the end of the impulse of tooth 61 on pallet stone 5. In this situation and following the rotation of rollers 1 in the direction of arrow a, beak 21 has passed over rising edge 25 of notch 22 made in small roller 23 and is then abutting on the circular periphery 24 of the small roller. Blocking member 6 has been continually driven in the direction of arrow h and reaches the end of its return travel. It can be seen that tooth 62, driven in the direction of arrow e, is preparing to be intercepted by locking means 80.

Figure 12:
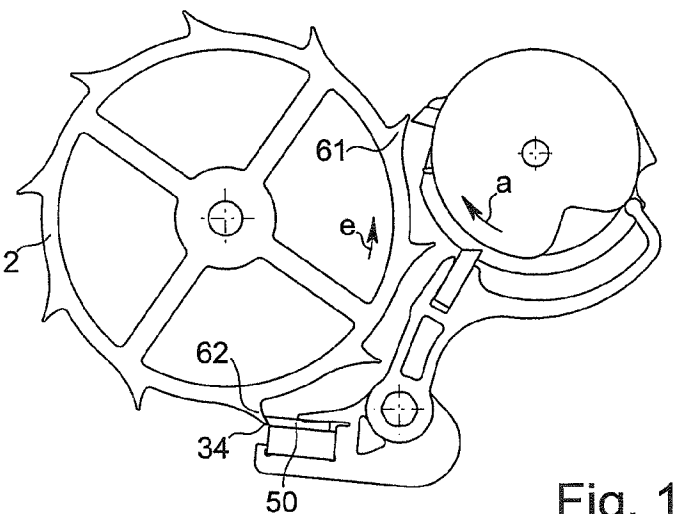

FIG. 12 shows the locking position. Tooth 62 abuts against the first locking plane 34 of the first locking pallet stone 50.

Figure 13:
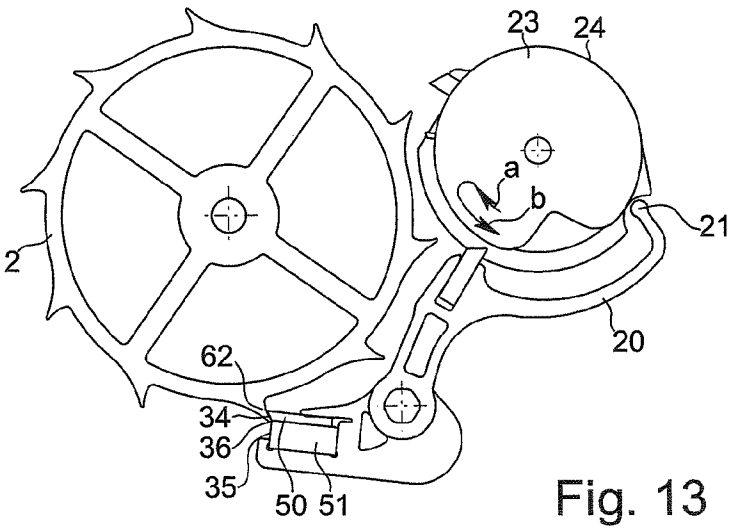

FIG. 13 shows the total locking of tooth 62 against the locking means formed here of first and second locking pallet stones 50 and 51. The tip of tooth 62, thrust by the kinetic energy of wheel 2, is housed on the locking line 36 formed by the inclination of the first and second locking faces 34 and 35 respectively belonging to the first and second locking pallet stones 50 and 51. This is the draw effect, well known to watchmakers, this effect enabling the stop pin, which was necessary for the proper working of the escapement disclosed in European Patent No. 03027929.3, to be omitted. Tooth 62 is thus housed on the locking line 36, while the second locking plane 35 stands before the tooth and prevents it from continuing on its path. FIG. 9 also shows that beak 21 of follower 20 has been released from circular periphery 24 of small roller 23, leaving the balance entirely free to continue its supplementary arc and to end its first vibration along the direction shown by arrow a. It will also be noted that from this moment onwards the escapement is resistant to any shocks that might affect the timepiece. Indeed, a shock could cause beak 21 to abut against periphery 24 of small roller 23, without causing pallet stones 50 and 51 to be unlocked, since the tooth 62 is immediately returned to locking line 36 owing to the aforementioned draw. Once the first vibration has finished, the balance reverses its direction and rotates in the direction of arrow b.

Figure 14:
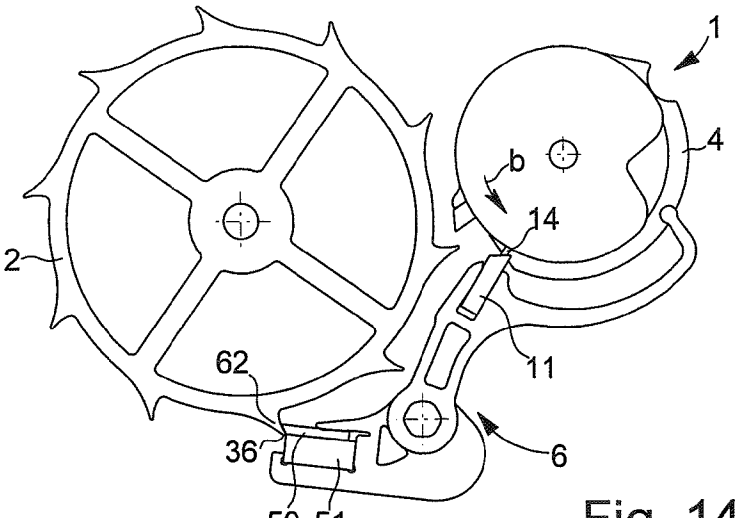

FIG. 14 shows the escapement at the end of the reverse supplementary arc, i.e. towards the end of the second vibration. Rollers 1 are rotating in the direction of arrow b. The Figure shows the situation at the moment when second finger-piece 14, which is surmounting large roller 4, enters into contact with first finger-piece 11 mounted on blocking member 6. The latter is still immobile and tooth 62 of wheel 2 is still housed on locking line 36 of pallet stones 50 and 51.

Figure 15:
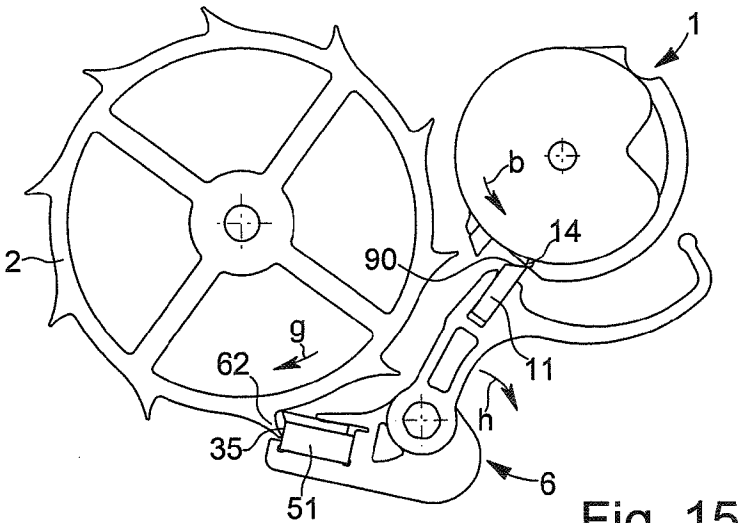

In FIG. 15, rollers 1 have continued their travel in the direction of arrow b and second finger-piece 14 has slid over a bevel 90 made at the end of first finger-piece 11 which causes the rotation of blocking member 6 in the direction of arrow h. Consequently tooth 62 of wheel 2 scales the second locking plane 35 of the second locking pallet stone 51, which drives wheel 2 in a slight backward movement noted here by the arrow g.

Figure 17:
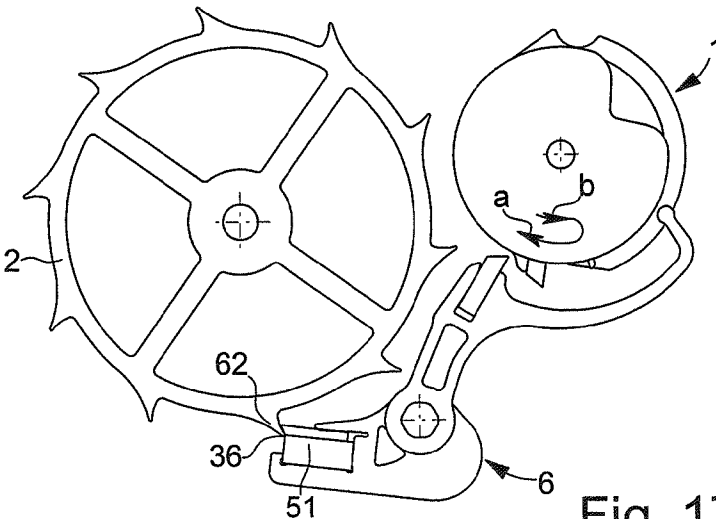
Figure 16:
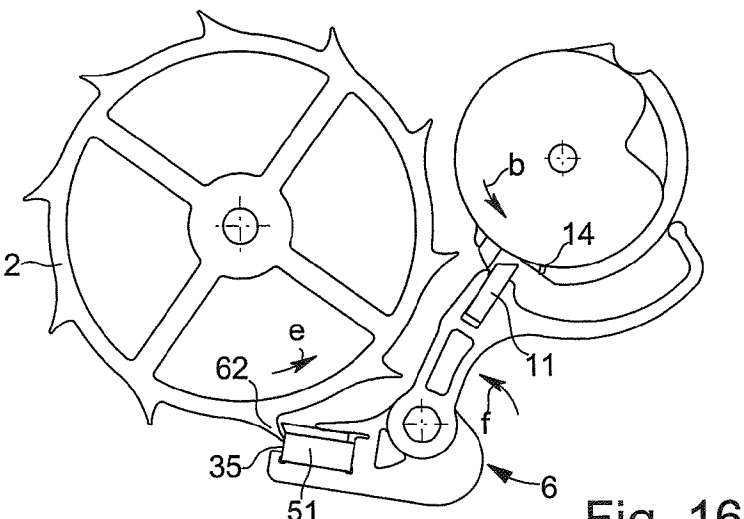

In FIG. 16 the first and second finger-pieces 11 and 14 have separated, with rollers 1 still rotating in the direction of arrow b. Henceforth, the tip of tooth 62, thrust by the kinetic energy of wheel 2, which is rotating in the direction of arrow e, descends the second locking face 35 of pallet stone 51 again to become housed on locking line 36 as is shown in FIG. 17. This is the same draw effect as mentioned with reference to FIG. 13, but acting on face 35 of pallet stone 51. This effect could be called "counter-draw".

From the situation shown in FIG. 17, the balance and therewith rollers 1 end their supplementary arc in the direction of arrow b then change direction (arrow a) to restart a new oscillation, the second vibration having finished.

All of the details explained hereinbefore show clearly that the encounter of finger-pieces 11 and 14 give rise to a torque about the rotational axis of blocking member 6 thereby creating a natural rotating movement of the blocking member. This was not the case of the aforementioned European Patent Application No. 03028877.3 where this encounter created a force perpendicular to the blocking member axis.

The second embodiment of the invention is illustrated in FIGS. 2 and 18, 18*a* to 21. Here, locking means 80 have only a single locking pallet stone 52, provided with a beak 40, the pallet stone having a first locking plane 37. Each tooth 3, 60, 62 of escape wheel 2 includes a second locking plane 38 which in turn has a locking line 39. The first locking plane 37 of pallet stone 52 intercepts a tooth 62 of wheel 2 when beak 21 of follower 20 is driven by the rising edge 25 of notch 22 and when rollers 1 are rotating in a first direction a. After this, beak 40 of pallet stone 52 is locked on locking line 39. The second locking plane 38 is then scaled by the same beak 40 when the first finger-piece 14 drives second finger-piece 11 and when rollers 1 are rotating in a second direction b. Finally, beak 40 of pallet stone 52 returns to locking line 39 when the second finger-piece leaves the first.

Various operating phases of the second embodiment of the invention will now be reviewed with reference to FIGS. 18, 18*a* to 21 and limited to the second vibration of the balance oscillation.

FIGS. 18, and 18*a* show the escapement at the end of the supplementary reverse arc, i.e. towards the end of the second vibration. Rollers 1 are rotating in the direction of arrow b. The Figure shows the situation when the second finger-piece 14, which is surmounting large roller 4, enters into contact with first finger-piece 11 mounted on blocking member 6. The latter is still immobile and beak 40 of pallet stone 52 is resting on locking line 39 of locking plane 38.

In FIG. 19, rollers 1 have continued their travel in the direction of arrow b and second finger-piece 14 has slid over a bevel 90 made at the end of first finger-piece 11, which causes blocking member 6 to rotate in the direction of arrow h. Consequently, beak 40 of pallet stone 52 scales the second locking plane 38, which drives wheel 2 in a slight backwards movement indicated here by the arrow g.

In FIG. 20, the first ands second finger-pieces 11 and 14 have separated, with rollers 1 still rotating in the direction of arrow b. Henceforth, beak 40 of pallet stone 52, thrust by the kinetic energy of wheel 2 which is rotating in the direction of arrow e, redescends the second locking plane 38 to be housed on locking line 39, as shown in FIG. 21. This is the counter-draw effect mentioned in relation to FIG. 17.

From the situation shown in FIG. 21, the balance and therewith rollers 1 end their supplementary arc in the direction of arrow b, then change direction (arrow a) to start a new oscillation, the second vibration having finished.

It will be noted here that this second embodiment of the invention has the advantage of relying on a single pallet stone 52 that has a simple shape and is easy to manufacture. Escape wheel 2 affected by locking planes 38 also does not present any manufacturing difficulties.

Figure 3:
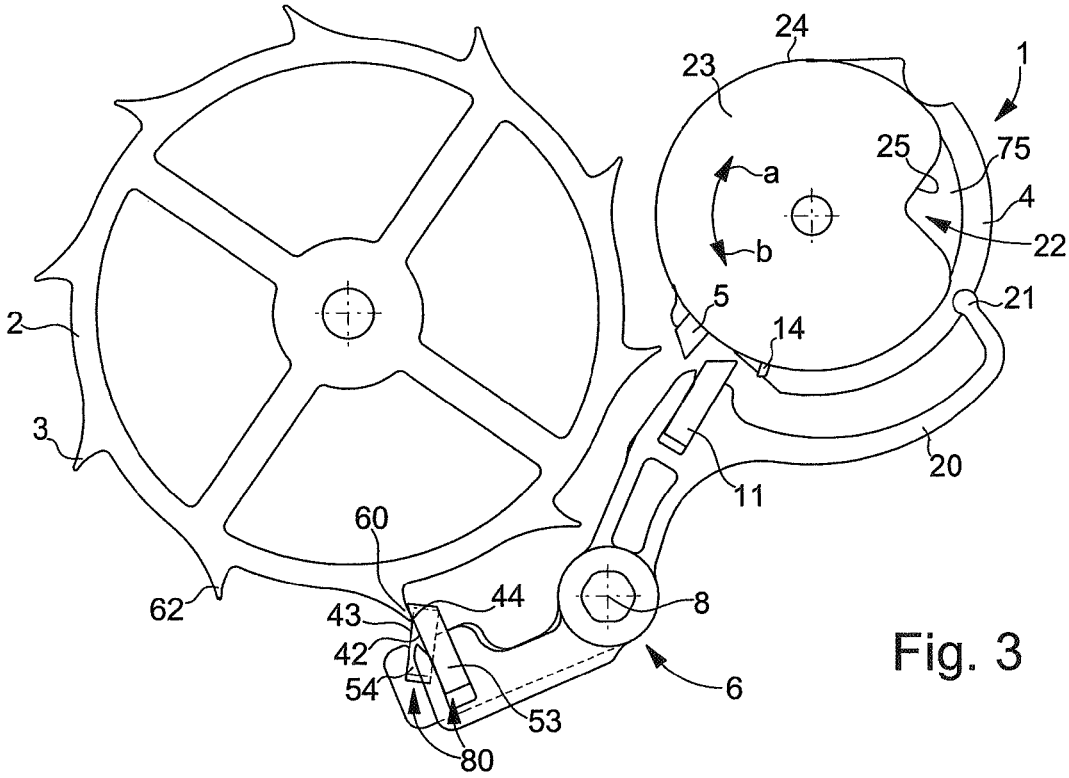
FIG. 3 is a plan view of a third embodiment of the escapement according to the invention.

The third embodiment of the invention will now be explained with reference to FIG. 3. The locking means 80 comprise here first and second pallet stones 53 and 54 arranged one on the other and respectively having first and second locking planes 42 and 43. These planes are inclined in relation to each other to form a locking line 44. The first locking line 42 intercepts a tooth 62 of wheel 2 when beak 21 of follower 20 is being driven by rising edge 25 of notch 22 and when rollers 1 are rotating in the first direction a. Tooth 62 then rests on locking line 39 by draw effect. After this, tooth 62 scales the second locking plane 43 when first finger-piece 14 drives second finger-piece 11 and when rollers 1 are rotating in second direction b. Finally tooth 62 returns to locking line 44 when the second finger-piece leaves the first via the counter-draw effect.

Figure 4:
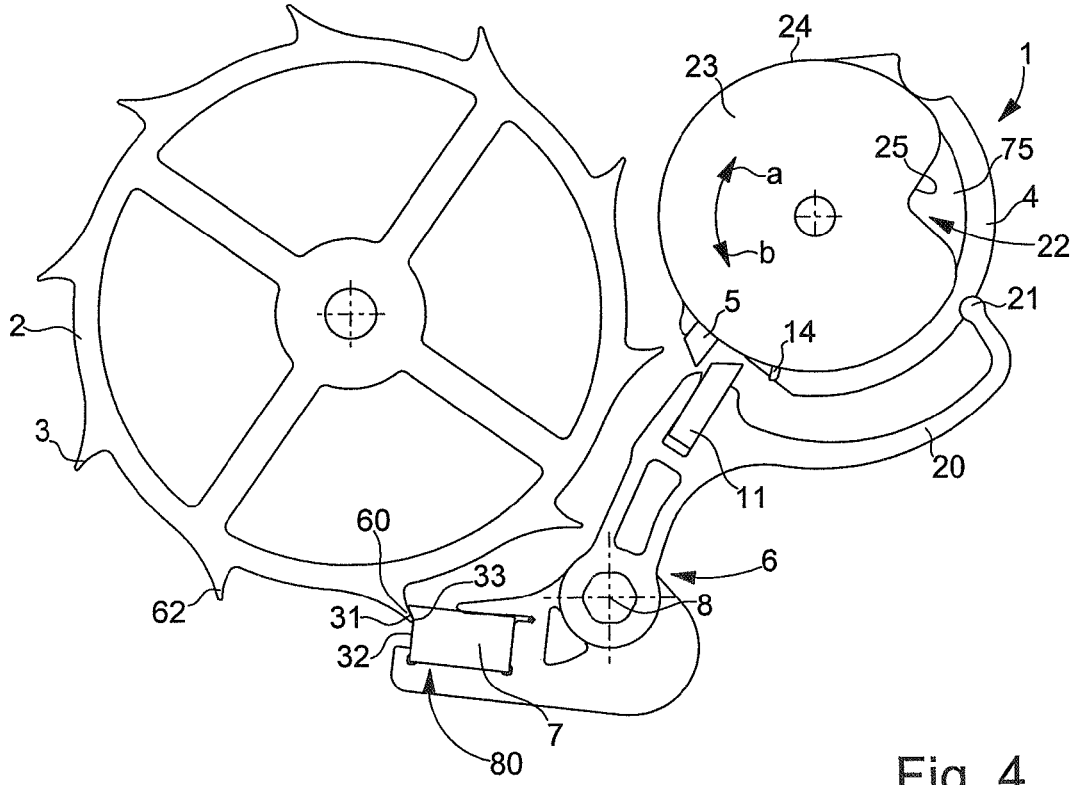
FIG. 4 is a plan view of a fourth embodiment of the escapement according to the invention.

The fourth embodiment of the invention refers to FIG. 4. Locking means 80 comprise a single locking pallet stone 7. This latter has a first locking plane 31 located at the front of the pallet stone and a second locking plane 32 located at the back of said pallet stone. The first and second locking planes are inclined in relation to each other to form a locking line 33. The first locking line 31 intercepts a tooth 62 of wheel 2 when beak 21 of follower 20 is being driven by the rising edge 25 of notch 22 and when rollers 1 are rotating in the first direction a. Tooth 62 then rests on locking line 33. After this, tooth 62 scales the second locking plane 32 when the first finger-piece 14 drives second finger-piece 11 and when rollers 1 are rotating in the second direction b. Finally, tooth 62 returns to locking line 3 when the second finger-piece leaves the first.

The locking means 80 described above are similar to the means explained in FIG. 1 with the exception of pallet stone 7 which is made in a single piece. It will be noted however that the manufacture of such a single-piece pallet stone is not easy and it is mentioned in this description solely for the sake of presenting an exhaustive list of the locking means.

Figure 5:
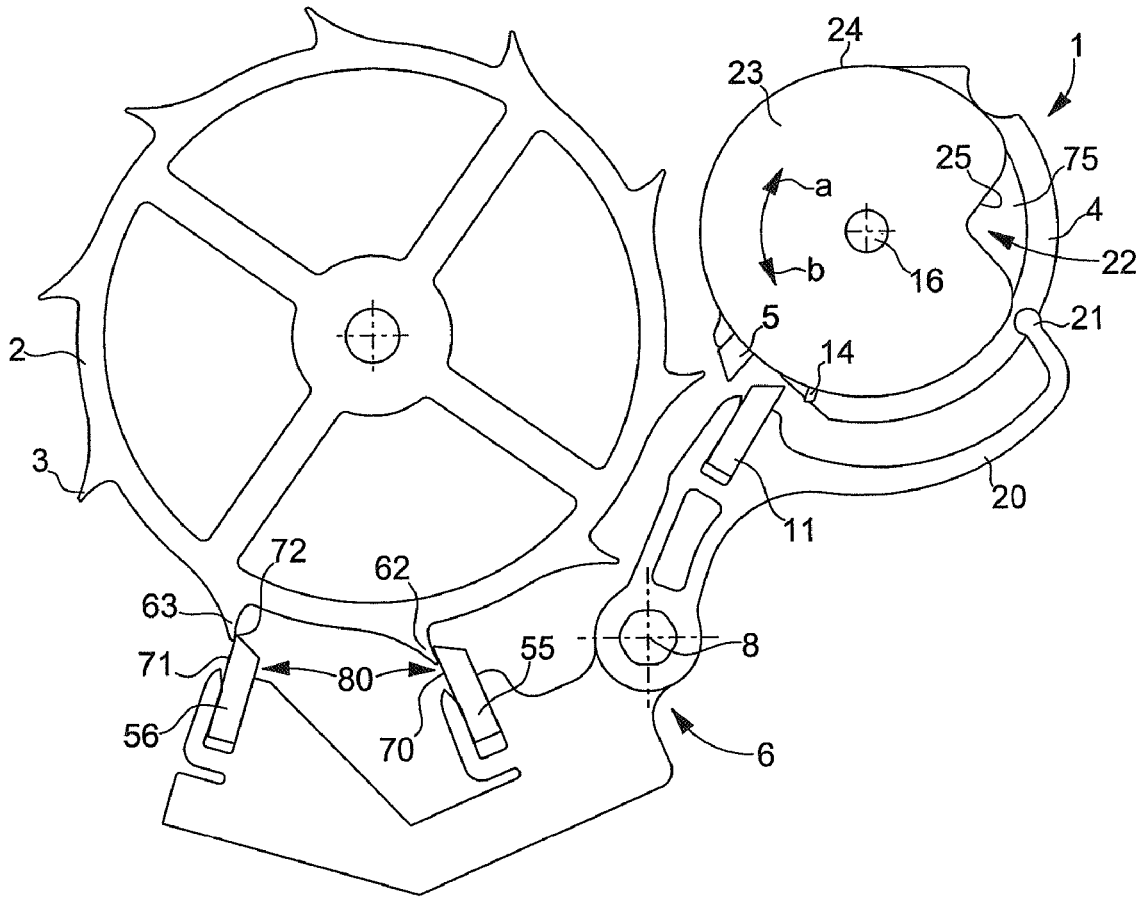
FIG. 5 is a plan view of a fifth embodiment of the escapement according to the invention.

The fifth embodiment of the invention relates to FIG. 5. Locking means 80 includes first and second locking pallet stones 55 and 56. These latter cooperate respectively with first and second teeth 62 and 63 of escape wheel 2. These first and second pallet stones 55 and 56 respectively have first and second locking planes 70 and 71. The first locking plane 70 intercepts first tooth 62 of wheel 2 when beak 21 of follower 20 is being driven by rising edge 25 of notch 22 and when rollers 1 are rotating in first direction a. The second tooth 63 of wheel 2 then scales the second locking plane 70 of pallet stone 56 when the first finger-piece 14 drives second finger-piece 11 and when rollers 1 are rotating in second direction b. Said first and second locking planes 70 and 71 are inclined in relation to the other such that second tooth 63 rests on a locking line 72 located on the second locking face 71 of second pallet stone 567 after the first tooth 62 has been intercepted by first pallet stone 55 and after the second finger-piece 11 has been driven by first finger-piece 14.

Thus ends the list of locking means able to ensure the proper working of the detent escapement according to the present invention. It has already been noted that this escapement has no use for any springs and in this resembles the escapement disclosed in European Patent Application No. 03028877.3 while proposing the significant improvements explained in the above description. It goes without saying however that if one retains the escapement disclosed in the aforecited patent application, said escapement could be fitted with the various locking means described in the present invention.

What is claimed is:

1. A detent escapement for a timepiece including an escape wheel fitted with teeth, a balance onto whose staff there are secured rollers including a large roller provided with an impulse pallet stone and surmounted by a first actuating finger-piece, and a small roller in the circular periphery of which a notch is made, and a blocking member in the form of a lever hinged on a pin, said blocking member carrying means for locking the escape wheel, a second actuating finger-piece and a follower ending in a beak arranged for cooperating with a rising edge of the notch of the small roller wherein the first and second actuating finger-pieces are rigidly secured respectively to the large roller and to the blocking member and arranged for cooperating with each other such that when the rollers are rotating in a first direction, the first finger-piece drives the second finger-piece to release the locking means from the escape wheel, the beak of the follower being then driven by the rising edge of the notch to re-engage the locking means in the escape wheel, and such that when the rollers are rotating in a second direction opposite to the first, the first finger-piece drives the second finger-piece to keep the locking means engaged in the escape wheel.

2. The detent escapement according to claim 1, wherein the locking means have first and second pallet stones arranged one beside the other and respectively having first and second locking planes inclined in relation to each other to form a locking line, the first plane intercepting a tooth of the wheel when, with the rollers rotating in the first direction, the beak of the follower is driven by the rising edge of the notch, after which the tooth rests on the locking line, said tooth finally scaling the second locking plane when, with the rollers rotating in the second direction, the first finger-piece drives the second finger-piece, said tooth returning to the locking line when the second finger-piece leaves the first.

3. The detent escapement according to claim 1, wherein the locking means include a single locking pallet stone provided with a beak, said pallet stone having a first locking plane and wherein each tooth of the escape wheel has a second locking plane in turn having a locking line, the first plane intercepting a tooth of the wheel when, with the rollers rotating in the first direction, the beak of the follower is driven by the rising edge of the notch, after which the beak of the pallet stone rests on the locking line, said beak finally scaling the second locking plane when, with the rollers rotating in the second direction, the first finger-piece drives the second finger-piece, said beak returning to the locking line when the second finger-piece leaves the first.

4. The detent escapement according to claim 1, wherein the locking means includes first and second locking pallet stones arranged one on the other and respectively having first and second locking planes inclined in relation to each other to form a locking line, the first plane intercepting a tooth of the wheel when, with the rollers rotating in the first direction, the beak of the follower is driven by the rising edge of the notch, after which the tooth rests on the locking line, said tooth finally scaling the second locking plane when, with the rollers rotating in the second direction, the first finger-piece drives the second finger-piece, said tooth returning to the locking line when the second finger-piece leaves the first.

5. The detent escapement according to claim 1, wherein the locking means includes a single locking pallet stone having a first locking plane located at the front of the pallet stone and a second locking plane located at the back of the pallet stone, the second plane being inclined in relation to the first to form a locking line, the first plane intercepting a tooth of the wheel when, with the rollers rotating in the first direction, the beak of the follower is driven by the rising edge of the notch, after which the tooth of the wheel rests on the locking line, said tooth finally scaling the second locking plane when, with the rollers rotating in the second direction, the first finger-piece drives the second finger-piece, said tooth returning to the locking line when the second finger-piece leaves the first.

6. The detent escapement according to claim 1, wherein the locking means include first and second locking pallet stones respectively cooperating with first and second teeth of the escape wheel, said first and second pallet stones respectively having first and second locking planes, the first locking plane intercepting the first tooth of the wheel when, with the rollers rotating in the first direction, the beak of the follower is driven by the rising edge of the notch, the second tooth of the wheel then scaling the second locking plane when, with the rollers rotating in the second direction, the first finger-piece drives the second finger-piece, said first and second locking planes being inclined in relation to each other such that the second tooth rests on the locking line located on the second locking plane of the second pallet stone after the first tooth has been intercepted by the first pallet stone and after the second finger-piece has been driven by the first.

* * * * *